United States Patent [19]

Tsuchiya et al.

[11] 4,211,356

[45] Jul. 8, 1980

[54] BUFFERED PACKAGE

[75] Inventors: Yoichiro Tsuchiya; Kazuhiro Kyoya, both of Tokyo, Japan

[73] Assignee: Trio Kabushiki Kaisha, Tokyo, Japan

[21] Appl. No.: 952,207

[22] Filed: Oct. 17, 1978

[30] Foreign Application Priority Data

Oct. 20, 1977 [JP] Japan ..... 52-141078

[51] Int. Cl.[2] ..... B65D 5/00

[52] U.S. Cl. ..... 229/16 R; 206/592; 206/586

[58] Field of Search ..... 206/334, 521, 523, 586, 206/591-592, 594; 229/16 R

[56] References Cited

U.S. PATENT DOCUMENTS

| | | | |
|---|---|---|---|
| 1,792,627 | 2/1931 | Bowersock | 206/591 |
| 2,877,942 | 3/1959 | Van Antwerpen | 206/591 X |
| 2,906,445 | 9/1959 | Tabakof et al. | 206/592 X |
| 3,221,973 | 12/1965 | Kalbrener | 206/591 X |
| 3,701,465 | 10/1972 | Richter | 206/523 X |
| 3,939,978 | 2/1976 | Thomaswick | 206/523 X |

*Primary Examiner*—Herbert F. Ross

*Attorney, Agent, or Firm*—Gerald J. Ferguson, Jr.; Joseph J. Baker

[57] ABSTRACT

A package and a blank for forming the package, the blank having buffer blocks so attached thereto as to facilitate the placement of an article within the package and the protection of the article once the package is closed.

18 Claims, 14 Drawing Figures

FIG. 4
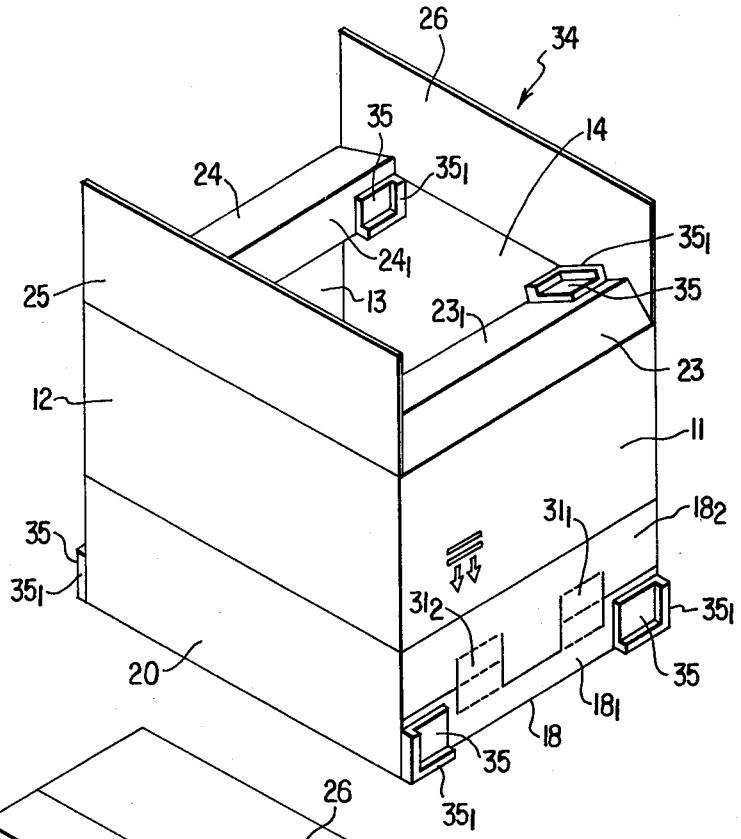
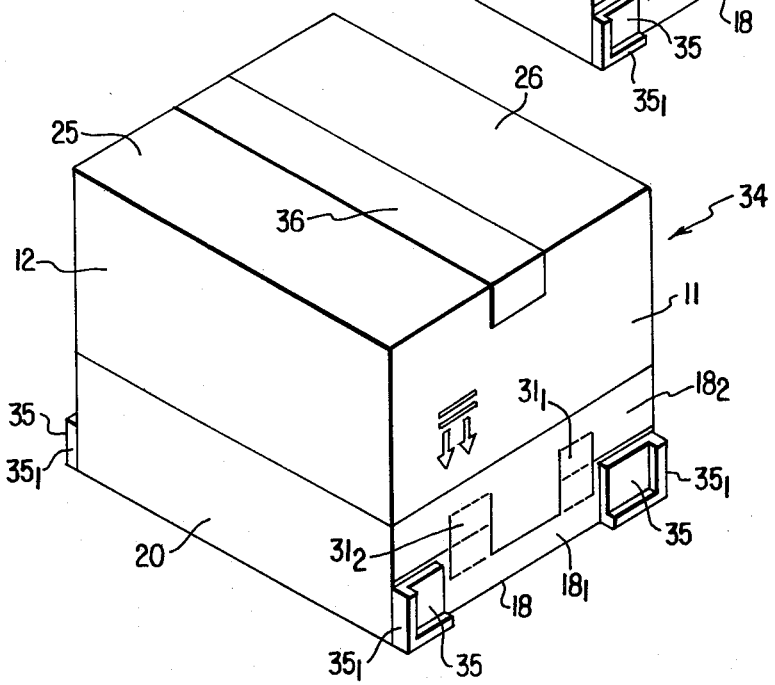
FIG. 5

FIG. 6
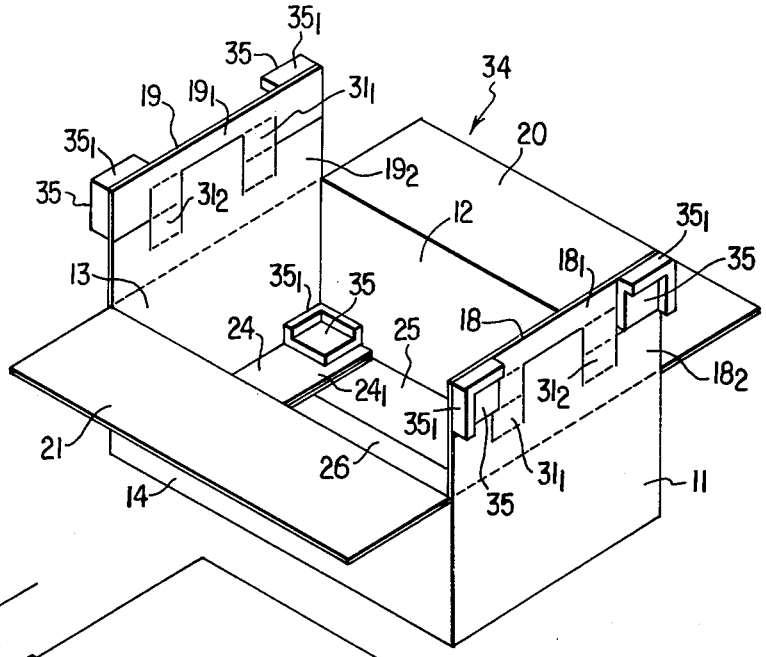
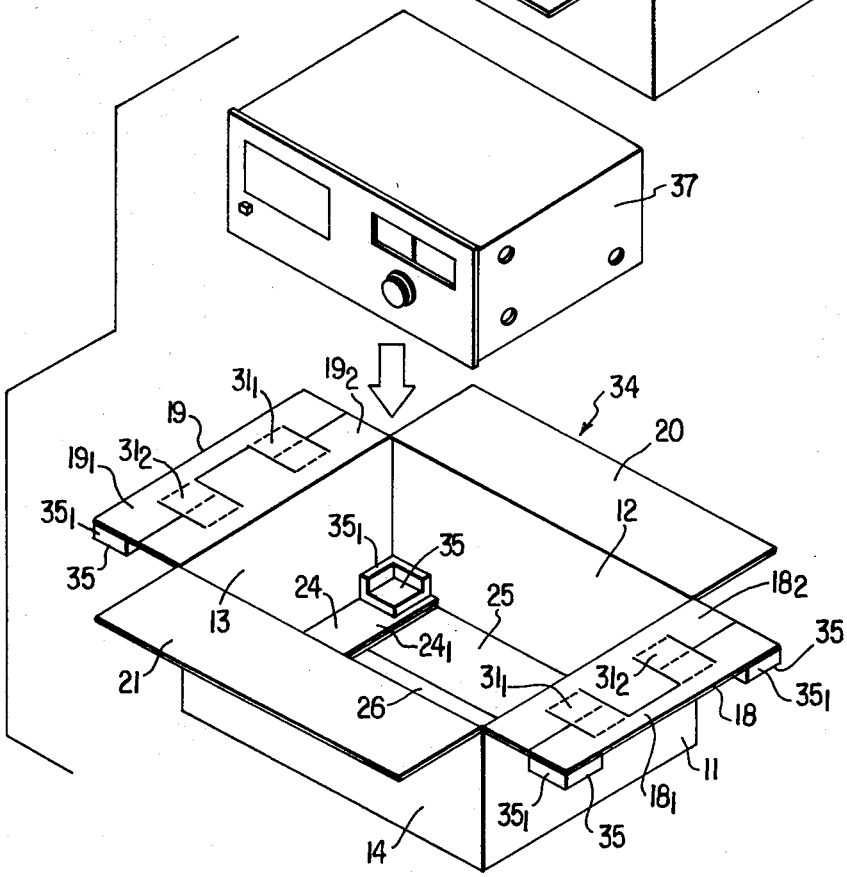
FIG. 7

FIG. 8
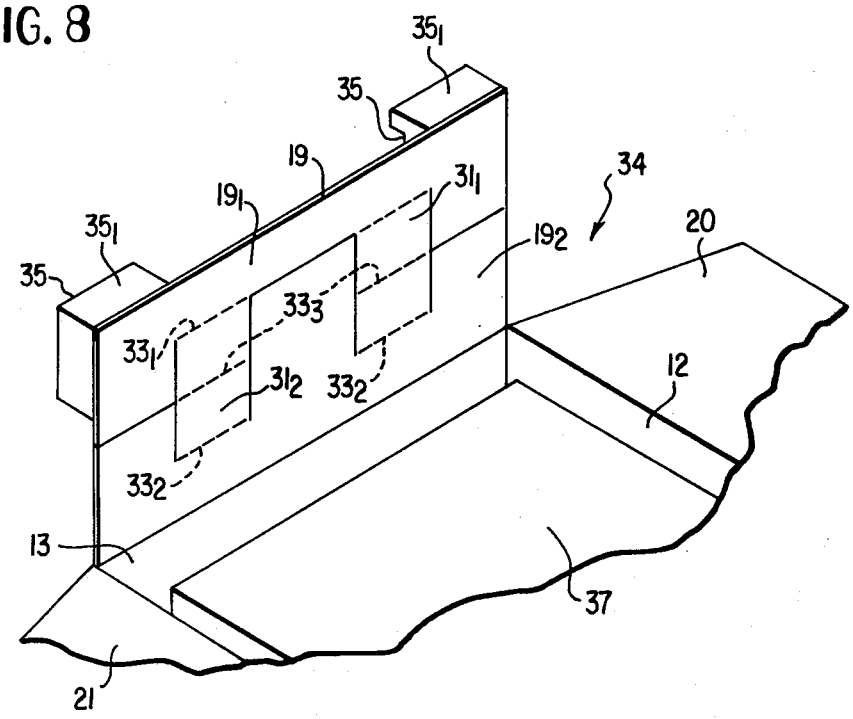
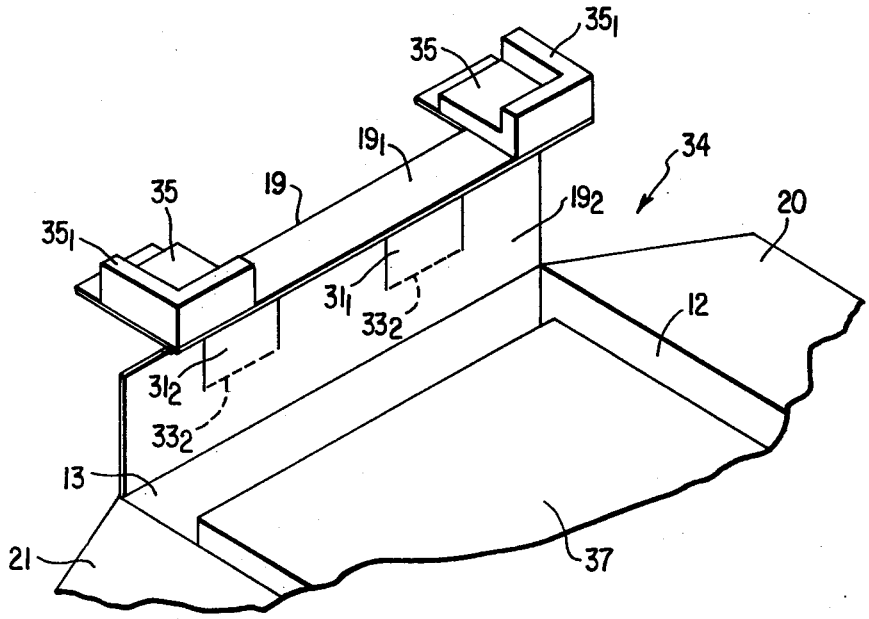
FIG. 9

BUFFERED PACKAGE

BACKGROUND OF THE INVENTION

1. Field of the Invention

This invention relates to packages used for packing electrical apparatus and various kinds of products.

2. Discussion of Prior Art

Conventionally, in packing an electrical apparatus, it has been necessary to fix the electrical apparatus with buffer blocks and place it in a box. Thus, electrical apparatus, e.g. amplifiers, has been packed in the past as shown in FIG. 1. Buffer blocks 2 are fitted on both sides of an amplifier 1, placed in box 3, and finally the box is sealed.

However, when box 3 and buffer blocks 2 are separate pieces as in the above conventional case, there are shortcomings in that the number of packaging man hours, package storage space, number of parts, control expense, and the volume of the box are great.

SUMMARY OF THE INVENTION

The present invention has its primary object the provision of a package not having the previous shortcomings and with a more favorable buffer effect where the box and buffer blocks are provided as one piece.

Other objects and advantages of this invention will be apparent from a reading of the following specification and claims taken with the drawing.

BRIEF DESCRIPTION OF THE DRAWING

FIGS. 3 through 13 are diagonal views showing various illustrative stages in the assembling process of the FIG. 2 package.

DETAILED DESCRIPTION OF PREFERRED EMBODIMENTS OF THE INVENTION

Figure 1:
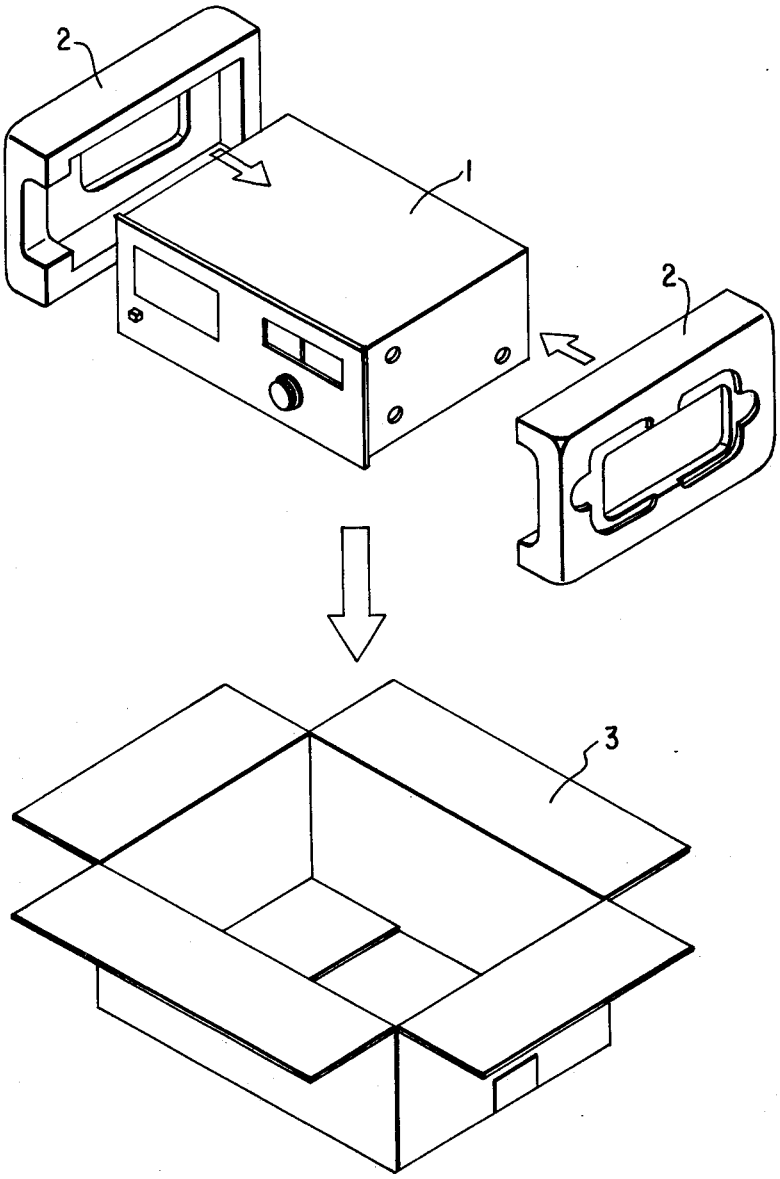
FIG. 1 (PRIOR ART)
FIG. 1 is a diagonal view explaining the conventional method of packing an amplifier.

Reference should be made to the drawing where like reference numerals refer to like parts.

Figure 2:
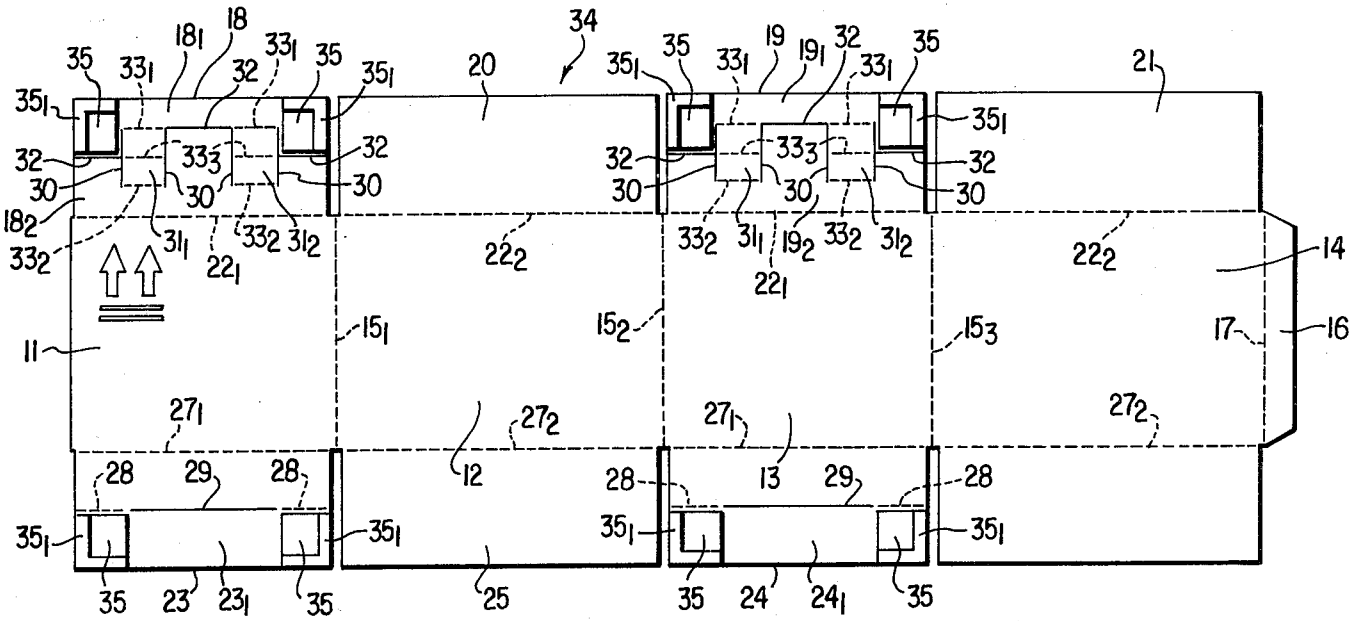
FIG. 2 is an expanded view showing one illustrative embodiment of a package based on the present invention.

FIG. 2 is an expanded view of an illustrative embodiment of a blank from which a package in accordance with this invention may be made, the outside of the package being shown. 11, 12, 13 and 14 are sides of the box, made of heavy cardboard such as corrugated cardboard, in a continuous, horizontal row and fold lines $15_1$, $15_2$, and $15_3$ are formed at the boundaries. At the side end of side 14, an overlap 16 extends as one piece from the side, and a fold line 17 is formed at the boundary of the overlap and side 14. At the top of sides 11 and 13, the upper inner flaps 18 and 19 of the box extend and at the top of sides 12 and 14, the upper outer falps 20 and 21 of the box extend respectively as one piece. Fold lines $22_1$ and $22_2$ are formed at the respective boundaries between (a) upper inner flaps 18 and 19 and the sides 11 and 13 and (b) upper outer flaps 20 and 21 and sides 12 and 14. On the other side, at the bottom of sides 11 and 13, the lower inner flaps 23 and 24 of the box extend and at the bottom of sides 12 and 14, the lower outer flaps 25 and 26 extend respectively as one piece from the sides. Fold lines $27_1$ and $27_2$ are formed at the respective boundaries between (a) the lower inner flaps 23 and 24 and sides 11 and 13 and (b) the lower outer flaps 25 and 26 and sides 12 and 14. On the lower inner flaps 23 and 24, a fold line 28 is formed in the vertical center so that the ends $23_1$ and $24_1$ can be folded in. In this case, for easier folding of the ends $23_1$ and $24_1$, the center part of the fold line may be a slit line 29.

On upper inner flaps 18 and 19, four slit lines 30 are formed in a parallel vertical direction and two arm pieces $31_1$ and $31_2$ are formed between the two pairs of slit lines. In addition, on upper inner flaps 18 and 19, slit lines 32 are made to divide the flaps into the fore-ends $18_1$ and $19_1$ and the after-ends $18_2$ and $19_2$ leaving the parts connected by arm pieces $31_1$ and $31_2$. In this case, the slit lines 32 are made such that fore-ends $18_1$ and $19_1$ form valleys and after-ends $18_2$ and $19_2$ form peaks. Furthermore, on arm pieces $31_1$ and $31_2$, fold lines $33_1$, $33_2$, and $33_3$ are made for flexible folding. In this case, fold line $33_1$ is formed at the end bordering the fore-ends $18_1$ and $19_1$; the fold line $33_2$, at the other end bordering the after-ends $18_2$ and $19_2$; and the fold line $33_3$, in the middle of the two ends. The box 34 is formed as described above, and on upper inner flaps 18 and 19 and lower inner flaps 23 and 24, buffer blocks 35 are preinstalled at the outer two corners of the fore-ends, $18_1$, $19_1$, $23_1$ and $24_1$. The buffer blocks are made of polyethylene, etc. and may have L-shaped walls $35_1$.

Figure 3:
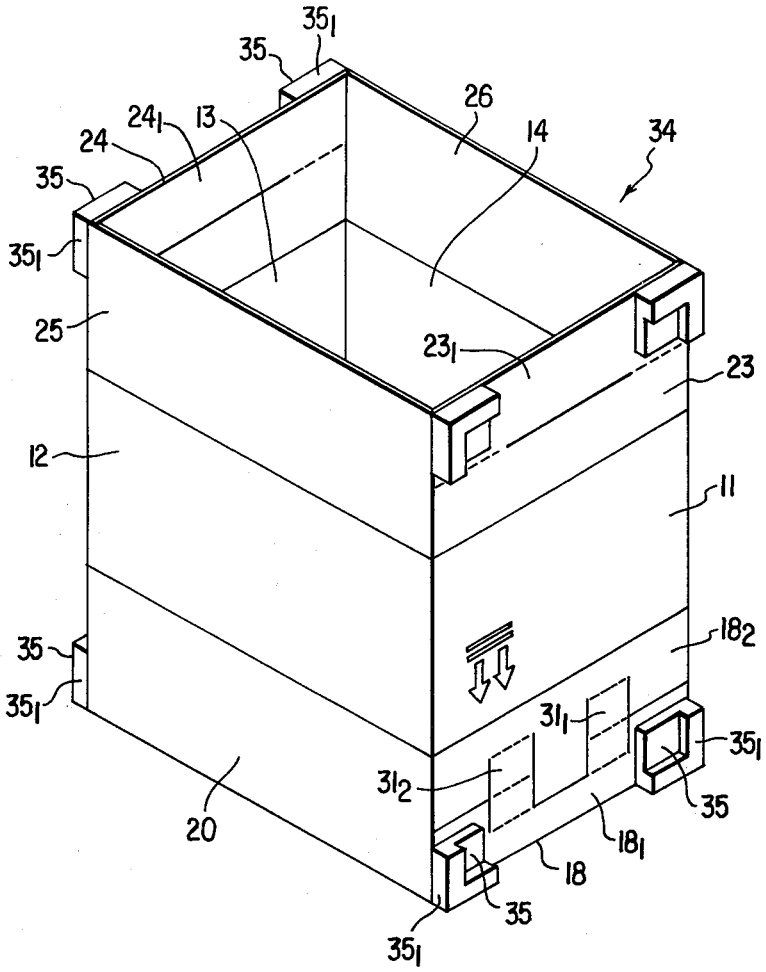
Figure 10:
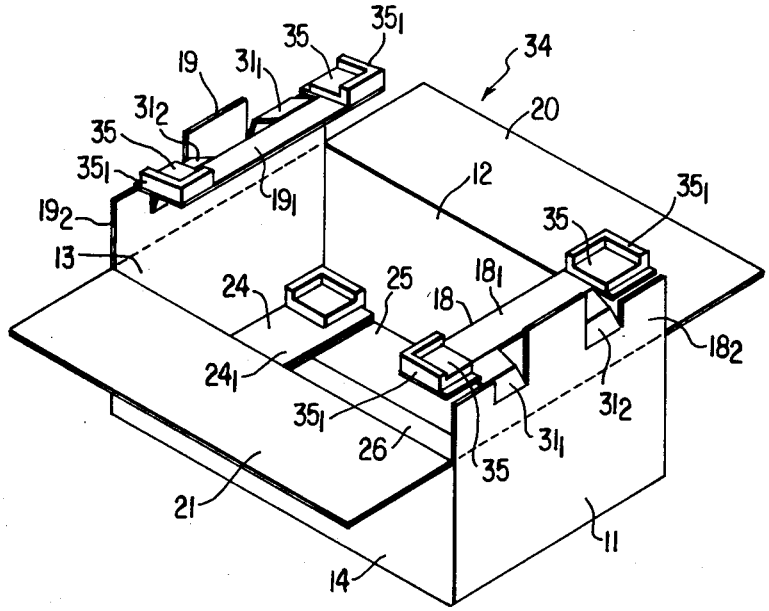
Figure 11:
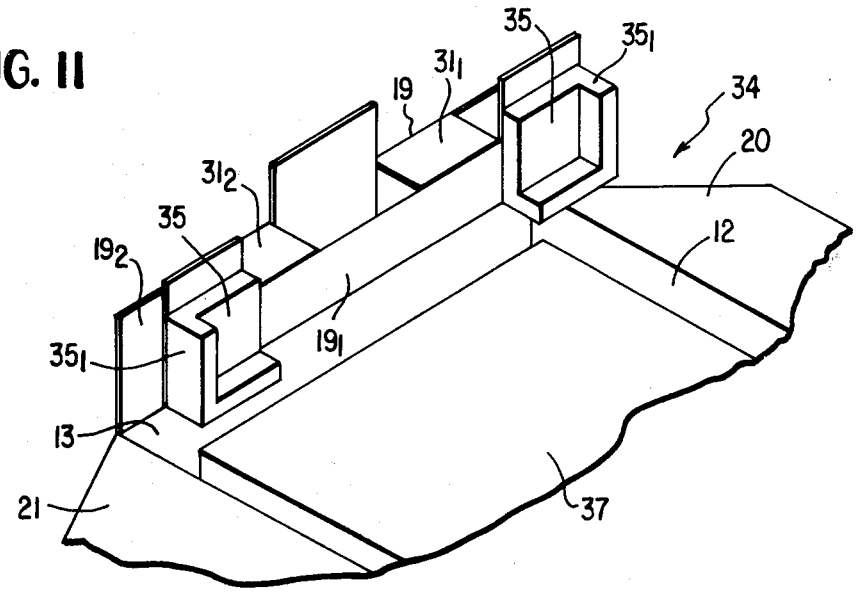

Box 34 and buffer blocks 35 comprise the package and assembling of the package will now be described. First, the sides 11, 12, 13 and 14 of box 34 are folded at fold lines $15_1$, $15_2$ and $15_3$ and, at the same time, the side edges of sides 11 and 14 are put together with overlap 16 (which may be coated with a pressure sensitive adhesive, for example) to assemble the angular barrel as shown in FIG. 3. When the package is to be stored, the box 34 assembled up to this point is collapsed flat for storage. In this case, buffer blocks 35 are on the outside of box 34, which enables folding of box 34 flat without intervening space. Also, if a large number of packages are piled up with buffer blocks 35 mutually staggered, they can be piled without taking too much space in storage.

When the package assembled up to the above state is to be used for packing electrical apparatus, for example amplifiers, it is assembled further as follows. First, the bottom of box 34 is assembled. As shown in FIGS. 4 and 5, assembling of the bottom consists of first folding in lower inner flaps 23 and 24, next folding lower outer flaps 25 and 26, and attaching a tape 36 over the lower outer flaps 25 and 26. In assembling the bottom, after the flaps have been folded as above, fore-ends $23_1$ and $24_1$ of lower inner flaps 23 and 24 are folded to the inside. In this case, the buffer blocks 25 are pre-attached on the two outer corners of fore-ends $23_1$ and $24_1$ of the lower inner flaps 23 and 24. Therefore, by folding in fore-ends $23_1$ and $24_1$ of lower inner flaps 23 and 24, buffer blocks 35 are simultaneously installed at the four inside corners of the bottom as it is assembled. After this, an amplifier 37 is placed in box 34 as shown in FIG. 7 by fitting in the lower part of amplifier 37 between walls $35_1$ of buffer blocks 35 at the four bottom corners of box 34. In placing the amplifier 37 in box 34, it is easier to work when upper inner flaps 18 and 19 and upper outer flaps 20 and 31 are spread outward.

Figure 12:
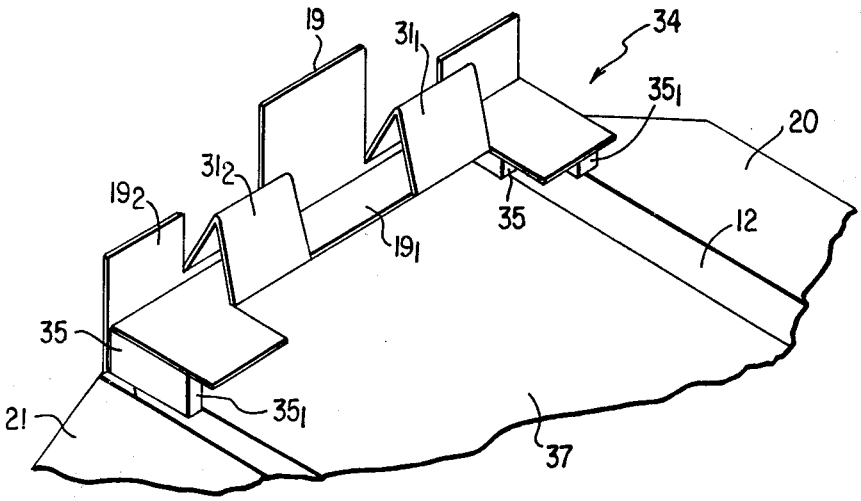
Figure 13:
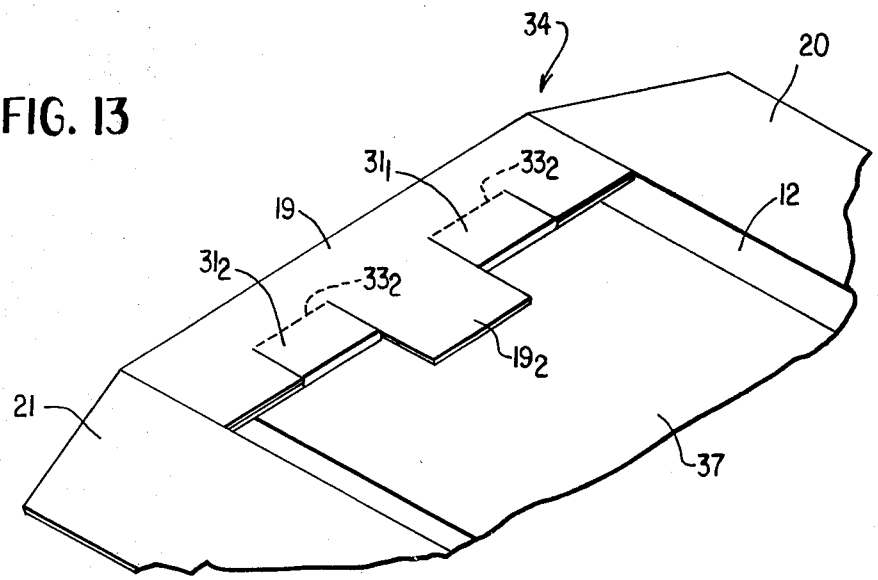

Then, the top of box 34 is assembled. Assembling the top consists of first folding upper inner flaps 18 and 19, then folding the upper outer flaps 20 and 21, and taping (not shown in the drawing) over the upper outer flaps 20 and 21. The upper inner flaps 18 and 19 are folded as shown in FIGS. 8 through 13. First, upper inner flaps 18 and 19 are placed in a vertical extension of sides 11 and 13 (See FIG. 8) and from this position, fore-ends $18_1$ and $19_1$ are folded in at right angles at fold lines $33_1$ (fold lines at one end of the arm piece $31_1$ and $31_2$) (See FIG. 9). Then, arm pieces $31_1$ and $31_2$ (one half side of them) are folded in at right angles at the center fold line $33_3$. At this time, fore-ends $18_1$ and $19_1$ are turned 90° downward so that they are doubled over inside of after-ends $18_2$ and $19_2$ with one horizontal side of arm pieces $31_1$ and $31_2$ in between (See FIGS. 10 and 11). Subsequently, the other sides of arm pieces $31_1$ and $31_2$ are folded in at fold lines $33_3$ (the fold line at the other ends of arm pieces $31_1$ and $31_2$ ) such that the fore-ends $18_1$ and $19_1$ are horizontal and meet after-ends $18_2$ and $19_2$ on the inside at a right angle. At this time, arm pieces $31_1$ and $31_2$ form inverted V's (See FIG. 12). Then, after-ends $18_2$ and $19_2$ are folded to the inside. Fore-ends $18_1$ and $19_1$ drop straight down and the after-ends $18_2$ and $19_2$ are folded over fore-ends $18_1$ and $19_1$ (See FIG. 13). The upper inner flaps 18 and 19 are folded in as above, buffer blocks 35 being pre-attached at both outer corners of fore-ends $18_1$ and $19_1$ as described above. Now, when fore-ends $18_1$ and $19_1$ are folded in to meet the inside of after-ends $18_2$ and $19_2$ at a right angle and horizontally (as shown in FIG. 12), buffer blocks 35 are positioned at the four upper corners of the box 34 facing down. When after-ends $18_2$ and $19_2$ are further folded in, fore-ends $18_1$ and $19_1$ drop straight down and the buffer blocks also drop at the same time. The buffer blocks fit on the upper surface of amplifier 37 by dropping down and their walls $35_1$ are inverted between amplifier 37 and sides 11, 12, 13 and 14 at the four corners to hold amplifier 37 in place.

One embodiment of this invention has been described above. In this package, buffer blocks 35 are pre-attached to the box 34. Therefore, when this package is used, it is effective in reducing the number of packaging man hours by about 10–20%, the package storage space by about 20–30%, the number of parts per package to one piece, the control expense to ⅓, and the volume of the box by about 10%. In addition, when this package is used, the bottom and the top of box 34 are in three layers when fore-ends $18_1$ and $19_1$ of upper inner flaps 18 and 19 and fore-ends $23_1$ and $24_1$ of lower inner flaps 23 and 24 are folded in. Thus, a more favorable buffer effect can be obtained. Furthermore, when this package is used, buffer blocks 35 are attached on the outside of box 34. Therefore, when storing packages by collapsing boxes 34 flat, they can be folded flat without intervening space. Also, a large number of packages can be piled without being bulky if the packages (boxes 34) are piled in such a way that buffer blocks 35 are staggered. This reduces storage space. Also, by piling the packages with buffer blocks 35 staggered, crushing of the buffer blocks can be prevented.

Figure 14:
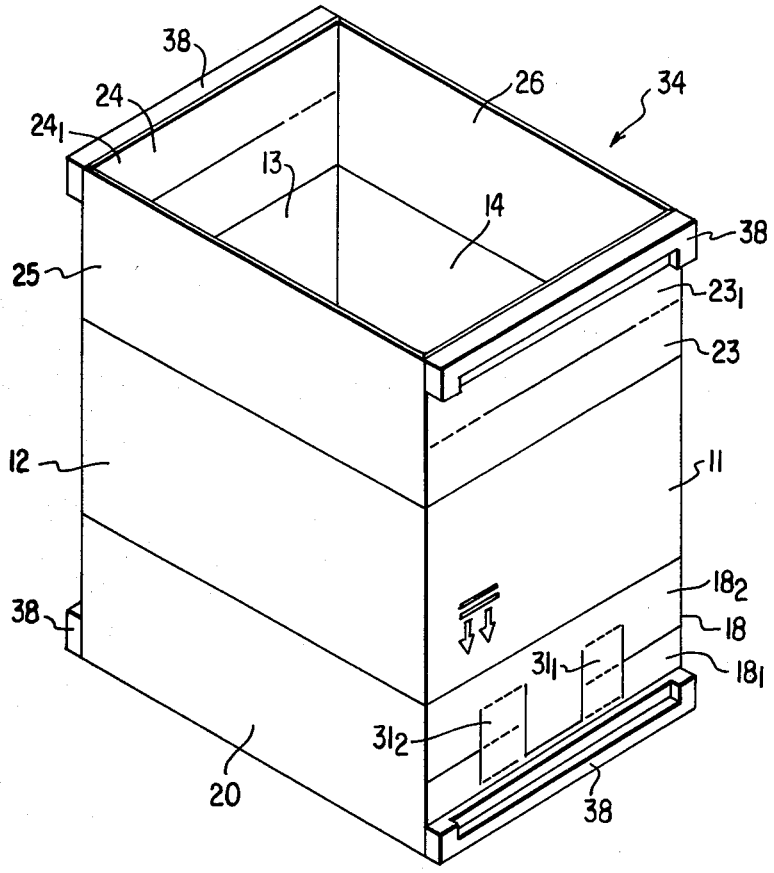
FIG. 14 is a diagonal view showing another illustrative embodiment of this invention.

FIG. 14 is a diagonal view showing another illustrative embodiment of this invention. In this case, bar-shaped buffer blocks 38 are attached in advance on the outside of fore-ends $18_1$, $19_1$, $23_1$ and $24_1$ of the upper inner flaps 18 and 19 and the lower inner flaps 23 and 24, filling the space between the pair of buffer blocks at both corners in the above illustrative embodiment.

As described above in detail, a package with numerous advantages can be produced by making the box and the buffer blocks as one piece according to the present invention.

What is claimed is:

1. In combination a generally rectangular blank of stiff, foldable material having top and bottom edges and two side edges, three fold lines generally extending between the top and bottom edges so that said blank can be folded along the three fold lines and said two side edges placed adjacent one another to thereby form an open, four-sided article, two fold lines in the top and bottom portions of each of the first and third of said four sides which respectively define upper and lower inner flaps in said first and third sides; and fold lines in each of said lower inner flaps which define a fore-end in each said lower inner flap, each said fore-end being adjacent said bottom edge of the blank; and at least one buffer means so attached to a predetermined side of each of said fore-ends that said open, four-sided article can be collapsed flat to form a flat article suitable for storage, said buffer means (a) being on the outside of the flat article to facilitate said storage and (b) being adapted to protect an article placed within a package formed from said open, four-sided article.

2. The combination in claim 1 including at least one further buffer means attached to each of said upper inner flaps which are adapted to further protect said article.

3. The combination as in claim 1 including means for defining in each of said upper inner flaps a fore-end and an after-end, each said last-mentioned fore-end being adjacent said top end of the blank; and at least one further buffer means attached to each said last-mentioned fore-ends which are adapted to further protect said article.

4. The combination as in claim 3 where said buffer means and said further buffer means each comprise at least a pair of blocks respectively attached to a pair of corners of its associated flap.

5. The combination as in claim 3 where said buffer means and said further buffer means each comprise at least a unitary block extending a pair of corners of its associated flap.

6. The combination as in claim 3 including two fold lines in the top and bottom portions of each of the second and fourth of said four sides which respectively define upper and lower outer flaps in said second and fourth sides which thereby permit said package to be closed.

7. The combination as in claim 3 including bridge means comprising at least one strip for connecting the fore-end and after-end of each upper inner flap to one another to thereby facilitate the positioning of said further buffer means with respect to said article.

8. The combination as in claim 7 where said strip is defined by a first pair of substantially parallel slits in each said upper inner flap extending parallel to the sides of said blank.

9. The combination as in claim 8 where said bridge means includes a further strip for connecting the fore-end and the after-end of each upper inner flap.

10. The combination as in claim 9 where said further strip is defined by a second pair of substantially parallel slits in each said upper inner flap extending parallel to the sides of said blank.

11. The combination as in claim 10 including first, second and third slits extending substantially parallel to the top edge of said blank for separating said fore-end and said after-end in each said upper inner flap, said first slit extending between a first side of each said upper inner flap to the slit of said first pair of slits adjacent said first side of the flap, said first slit intersecting the last-mentioned slit of the first pair of slits at a point intermediate the ends of the last-mentioned slit, said second slit extending between the other side of each said upper inner flap to the slit of said second pair of slits adjacent said other side of the flap, said second slit intersecting the last-mentioned slit of the second pair of slits at a point intermediate the ends of the last-mentioned slit, said third slit extending from the slit of said first pair of slits which is removed from said first side of the flap to the slit of said second pair of slits which is removed from said other side of the flap, said third slit intersecting said last-mentioned slits at the ends thereof adjacent said top edge of the blank.

12. The combination as in claim 1 including attaching means adapted for attaching the first and fourth sides of said four sides to one another after said two side edges are placed adjacent one another.

13. The combination as in claim 12 where said attaching means includes an overlap which extends from one of said two side edges.

14. The combination as in claim 13 including a pressure sensitive adhesive coated on said overlap.

15. In combination a generally rectangular blank of stiff, foldable material having top and bottom edges and two side edges, three fold lines generally extending between the top and bottom edges which define four sides of a package to be formed from said blank, two fold lines in the top and bottom portions of each of the first and third of said four sides which respectively define upper and lower inner flaps in said first and third sides;

fold lines in each of said lower inner flaps which define a fore-end in each said lower flap, each said fore-end being adjacent said bottom edge of the blank;

means for defining in each of said upper flaps a fore-end and an after-end, each said last-mentioned fore-end being adjacent said top end of the blank;

bridge means comprising at least one strip defined by a first pair of substantially parallel slits in each said upper inner flap extending parallel to the sides of said blank, said one strip connecting the fore-end and after-end of each upper inner flap to one another; and at least one buffer means attached to each of said fore-ends of the lower inner flaps, said one buffer means being adapted to protect an article placed within said package; and at least one further buffer means attached to each of said fore-ends of the upper inner flaps, said further buffer means being adapted to further protect said article and where said one strip facilitates the positioning of said further buffer means with respect to the article.

16. The combination as in claim 15 where said bridge means includes a further strip for connecting the fore-end and the after-end of each upper inner flap.

17. The combination as in claim 16 where said further strip is defined by a second pair of substantially parallel slits in each said upper inner flap extending parallel to the sides of said blank.

18. The combination as in claim 17 including first, second and third slits extending substantially parallel to the top edge of said blank for separating said fore-end and said after-end in each said upper inner flap, said first slit extending between a first side of each said upper inner flap to the slit of said first pair of slits adjacent said first side of the flap, said first slit intersecting the last-mentioned slit of the first pair of slits at a point intermediate the ends of the last-mentioned slit, said second slit extending between the other side of each said upper inner flap to the slit of said second pair of slits adjacent said other side of the flap, said second slit intersecting the last-mentioned slit of the second pair of slits at a point intermediate the ends of the last-mentioned slit, said third slit extending from the slit of said first pair of slits which is removed from said first side of the flap to the slit of said second pair of slits which is removed from said other side of the flap, said third slit intersecting said last-mentioned slits at the ends thereof adjacent said top edge of the blank.

* * * * *